US007670082B2

(12) United States Patent
Olsta et al.

(10) Patent No.: US 7,670,082 B2
(45) Date of Patent: Mar. 2, 2010

(54) CONTAMINANT-REACTIVE GABION AND METHOD OF MANUFACTURE AND USE

(75) Inventors: James T. Olsta, Bartlett, IL (US); Charles J. Hornaday, Arlington Heights, IL (US)

(73) Assignee: Amcol International Corporation, Hoffman Estates, IL (US)

( * ) Notice: Subject to any disclaimer, the term of this patent is extended or adjusted under 35 U.S.C. 154(b) by 395 days.

(21) Appl. No.: 11/742,068

(22) Filed: Apr. 30, 2007

(65) Prior Publication Data

US 2008/0264546 A1 Oct. 30, 2008

(51) Int. Cl.
*B09B 1/00* (2006.01)

(52) U.S. Cl. ..... 405/15; 405/129.75

(58) Field of Classification Search ..... 405/129.45, 405/129.6, 129.75, 15
See application file for complete search history.

(56) References Cited

U.S. PATENT DOCUMENTS

| | | | | |
|---|---|---|---|---|
| 4,250,172 | A | 2/1981 | Mutzenberg et al. | |
| 4,622,260 | A | 11/1986 | Tesch | |
| 5,043,076 | A | 8/1991 | Alexander | |
| 5,237,945 | A | 8/1993 | White | |
| 5,346,565 | A | 9/1994 | White | |
| 5,368,410 | A * | 11/1994 | Ferraiolo | 405/15 |
| 5,900,085 | A | 5/1999 | Clarey et al. | |
| 6,368,017 | B2 * | 4/2002 | Black | 405/15 |
| 6,379,543 | B1 * | 4/2002 | Bowman | 405/129.45 |
| 6,610,781 | B1 | 8/2003 | Zhou et al. | |
| 7,128,498 | B2 | 10/2006 | Sheahan et al. | |
| 2005/0103707 | A1 * | 5/2005 | Olsta et al. | 210/502.1 |

FOREIGN PATENT DOCUMENTS

GB 2337723 A 12/1999

OTHER PUBLICATIONS

Lorah et al., "Development and Performance Monitoring of a Dechlorinating Culture and an Innovative Bioremediation Remedy at the Ground-Water/Surface-Water Interface," Groundwater/Porewater/Surfacewater Interactions (Platform Papers).

D. Instanes, "Pollution Control of a Norwegian Fjord by Use of Geotextiles," Proceedings, The Fifth International Conference on Geotextiles, Geomembranes and Related Products, Singapore, pp. 1053-1056, (1994).

(Continued)

*Primary Examiner*—John Kreck
(74) *Attorney, Agent, or Firm*—Marshall, Gerstein & Borun LLP

(57) ABSTRACT

Reactive gabion/geocomposite articles, and their methods of manufacture, for controlling contaminants in soil, sediment or water that allow the passage of essentially non-contaminated water therethrough. The articles and methods described herein utilize gabions, which are box shaped cages or grids (see FIG. 2) made of either steel wire mesh or plastic. In one embodiment, the reactive geotextile mats are lined on the top major surface with a gabion cage or grid. In other embodiments, the cages or grids surround a geocomposite containing reactive material. The gabion/geocomposite articles can be constructed in-situ (at the site of deployment) or remotely (on land or barge) and set in place. They are typically placed side-by-side and, in a preferred embodiment, are configured to cover a target sediment area, underwater. The gabion/geocomposite articles may be filled with clean sediment, silt, sand and/or concrete block or rock to hold the reactive geocomposite in place and for armoring.

8 Claims, 5 Drawing Sheets

OTHER PUBLICATIONS

Ling et al., "Appendix C: Case Studies on Geotechnical Aspects of In-Situ Sand Capping," Guidance for In-Situ Subaqueous Capping of Contaminated Sediments, pp. C1-C19 (1998).

S. Maynord, "Appendix A: Armor Layer Design," Guidance for In-Situ Subaqueous Capping of Contaminated Sediments, pp. A1-A15 (1998).

* cited by examiner

CONTAMINANT-REACTIVE GABION AND METHOD OF MANUFACTURE AND USE

FIELD OF THE INVENTION

The present invention is directed to reactive gabion/geocomposite articles for controlling or preventing the further spread of contaminants in soil, sediment or water. More particularly, the reactive gabion/geocomposite articles described herein include a reactive core geocomposite mat in contact with a gabion cage or grid, wherein the geocomposite mat contains a powdered or granular reactive material, such as activated carbon, coke breeze, peat moss, polymeric ion exchange resins, polymeric adsorbing resins; zero-valent iron, magnetite, apatite, organophilic clay, zeolite, diatomaceous earth; contaminant-degrading microbes; or mixtures thereof. The geocomposite mat is liquid-permeable and is in contact with an upper gabion cage or grid that is weighted, e.g., with rock or the like, before, after or during positioning. In another embodiment, a flexible gabion cage or grid is wrapped around the reactive geocomposite, to sandwich the reactive geocomposite within a folded gabion cage or grid, thereby covering the upper and lower major surfaces of the reactive geocomposite with the gabion cage or grid. In all embodiments that incorporate a reactive geocomposite mat, the mat may be secured to the weighted gabion cage or grid mechanically, by heat bonding, or adhesively, or simply held under the weighted gabion cage or grid without mechanical fastening, heat bonding, or adhesive fastening.

BACKGROUND AND PRIOR ART

In-situ capping of underwater contaminants involves the placing of a subaqueous cover over contaminated sediments to stabilize sediments, minimize their re-suspension and transport, and reduce dissolved contaminant transport into surface waters.

In past applications, in-situ capping has typically been constructed with either, a) loosely placed clean sediment, silt and sand; b) bulk reactive material such as organoclay, or c) a low permeability liner such as geomembrane or geosynthetic clay liner; or d) reactive geocomposite mat.

Disadvantages of loosely placed clean sediment, silt or sand are: low carbon content requires relatively thick cap; the material may segregate upon settling resulting in stratified layers; benthic organisms may burrow into the material.

Disadvantages of bulk reactive material are: the angle of repose requires material on the sides beyond the area of concern, and difficulty in placing the material through water.

A disadvantage of low permeability liners is that they may be subject to uplift from gases generated by the sediment below the liner.

The prior art is replete with methods and articles used to confine or store a wide variety of environmental contaminants ranging from completely capping, in-situ, contaminated sediments that are left in-place in underwater environments; terrestrial landfills wherein dredged or otherwise collected contaminated sediments are placed within an engineered disposal site surrounded with an impervious liner system and capped with an impervious material; and the use of a reactive mat and/or reactive backfill that surrounds the contaminated material. Examples of reactive geocomposites and mats are found in U.S. Pat. No. 6,284,681 B1 ('681) and published application US 2002/0151241 A1 ('241). The reactive geocomposites described in these two publications include one or more layers of reactive material each surrounded by outer geotextiles that allow contaminated liquid to pass through the reactive layer for sorption or reaction of the contaminants with a reactive material contained between the outer geotextile layers, and in the case of the '241 published application, the geocomposite may be deployed vertically.

One of the major problems encountered with the use of reactive mats for controlling or confining contaminated materials, or in controlling or preventing leaching of contaminants from sediments and preventing the contaminants from entering ground water supplies, and particularly from ground water traversing upwardly through a lake or ocean soil interface into the lake or ocean, is in the ability to provide a transportable, integral mat having a sufficient volume or thickness of reactive material so that the mat provides very long term protection without the necessity of periodic replacement. The reactive mats described in the '681 patent and in the '241 publication provide alternating layers of geotextile/reactive material/geotextile/reactive material since a sufficient thickness of reactive material cannot be provided in a single reactive material core layer without that reactive material being lost during transportation or installation. The mat disclosed in U.S. Pat. No. 7,128,498 does not have adjacent layers interconnected but relies upon a rock covering layer to maintain the mat in position. The mat disclosed in the '498 patent has separate layers that are not structurally interconnected and may easily separate due to the powerful hydraulic force experienced with lake and river ground water supplies. Also, deployment of separate geotextiles and reactive materials through a water column is difficult.

This assignee's U.S. Pat. Nos. 5,237,945 ('945) and 5,389,166 ('166) describe the manufacture of a water barrier formed from a clay-fiber mat that may include a powdered or granular bentonite clay, a powdered or granular liquid-interacting material, e.g., a contaminant-reactant, or providing the contaminant-reactant as a separate layer in the water barrier product. The water barrier mat formed in accordance with the '945 and '166 patents is manufactured by laying down geosynthetic fibers and the water swellable clay, with or without the contaminant-reactant material, simultaneously. In this manner, a geosynthetic composite material can be manufactured wherein the geosynthetic fibers are surrounded by the water-swellable clay, with or without the contaminant-reactant material, in initially forming a relatively thick geotextile that essentially prevents water flow-through (maximum water-permeability of $1\times10^{-7}$ cm/sec.). Such a mat must be subsequently consolidated and the fibers must be substantially densified after the initial formation of the mixture of powdered or granular material and fibers in an attempt to secure the fibers in position surrounding the powdered or granular material.

SUMMARY

In brief described herein are reactive gabion/geocomposite articles, and their methods of manufacture, for controlling contaminants in soil or water that allow the passage of essentially non-contaminated water therethrough. The articles and methods described herein utilize gabions, which are box shaped cages or grids (see FIG. 2) made of either steel wire mesh or plastic. In one embodiment, the reactive geotextile mats are lined on the top major surface with a gabion cage or grid. In other embodiments, the cages or grids surround a geocomposite containing reactive material. The typical thickness (height) of the gabion grids is 2 inches to 3 feet. The gabion/geocomposite articles can be constructed in-situ (at the site of deployment) or remotely (on land or barge) and set in place. They are typically placed side-by-side and, in a preferred embodiment, are configured to cover a target sediment area, underwater. The gabion/geocomposite articles are heavy enough to sink and hold the geotextile in place or may be covered or at least partially filled with clean sediment, silt, sand and/or concrete block or rock to hold the reactive geocomposite mat in place and for armoring.

Advantages of Reactive Gabion/Geocomposite Articles

1. Higher reactivity and/or adsorption of reactive material on a unit thickness basis allows for thinner cap thickness than clean sediment, silt and sand.
2. A gabion has several advantages over loose placement of reactive or adsorptive materials, including:
   a. The outer walls or edges of the reactive geocomposite mat may be made water-impermeable, e.g., using an impermeable geomembrane, to prevent water from traveling horizontally and out of the gabion/geocomposite article without complete treatment by the reactive material;
   b. more uniform thickness and mass per unit area placement of reactive or adsorptive material;
   c. ability to conduct thickness and mass per unit area quality control/quality assurance prior to placement;
   d. ability to mix reactive or adsorptive materials in defined proportions;
   e. geotextiles provide separation of the reactive material from the contaminated sediment and cover material;
   f. geotextiles provide resistance to biointrusion;
   g. geosynthetic reinforcement provides resistance to uplift and separation of reactive/adsorptive materials from gas migration; and
   h. geosynthetic reinforcement provides increased stability on slopes.

A second embodiment is a two-step system with a reactive geosynthetic mat or geosynthetic clay liner mat containing reactive material overlain by a rock-filled gabion.

Advantages of Reactive Gabion/Geocomposite Mat System:

1. Mat provides complete coverage;
2. gabion allows consolidation; and
3. gabion/mat will not be displaced by gas uplift or scour.

In one embodiment, a liquid-permeable reactive geocomposite mat, or reactive material-containing geocomposite mat, such as disclosed in this assignee's U.S. patent application Ser. No. 11/599,080, filed Nov. 14, 2006, hereby incorporated by reference, containing one or more reactive materials, is disposed under a lower major surface of a rock filled or partially filled gabion. The weighted gabion cage or grid prevents the reactive geosynthetic mat from movement from its position during use, transportation, installation, and deployment.

Suitable powdered or granular contaminant-reactive materials include organophilic clay, activated carbon, coke breeze, zero-valent iron, magnetite, apatite, zeolite, peat moss, polymeric ion exchange resins, polymeric adsorbents, contaminant-degrading microbes and mixtures thereof. The geocomposite mat can be inoculated with microbes or microorganisms and optionally, a food supply for the microorganisms, as disclosed in application Ser. No. 11/221,019, filed Sep. 7, 2005, hereby incorporated by reference. Any water-permeable geosynthetic sheets or fabrics may be used to form the reactive geocomposite articles, such as polyolefins, e.g., polypropylene, polyethylene and copolymers thereof, rayon; polyesters; nylon; acrylic polymers and copolymers; polyamides; polyamide copolymers; polyurethanes, and the like.

The method of manufacture permits the manufacture of a reactive gabion/geocomposite article that includes a contaminant-reactant material that is structurally secure, without lateral movement, and contains contaminant-reactant material that maintains its uniform disposition throughout the reactive geocomposite mat.

A powdered or granular water-swellable clay material can be applied in a relatively high concentration at or near the edges of the reactive geocomposite mats, adjacent to one or both major surfaces to permit the water-swellable clay to extrude through the edges of the gabions, thereby creating a sealing layer for sealing seams between adjacent reactive gabion/geocomposite articles.

Accordingly, one aspect of the contaminant-reactive gabion/geocomposite articles described herein is to provide a new and improved water-permeable article of manufacture and method of making the article by incorporating a powdered or granular contaminant-reactant material into a gabion cage containment structure, e.g., a reactive geocomposite mat, wherein the reactive material is encased within or between one or more water-permeable geotextile sheets or fabrics, and the composite is held in position within or below a weighted gabion grid or cage.

A further aspect of the gabion/geocomposite articles described herein is to provide a new and improved article of manufacture including a powdered or granular contaminant-reactant or contaminant-interacting material contained in a reactive geocomposite article that is contained within or below a weighted gabion grid or cage structure, wherein the contaminant-reactive material is selected from the group consisting of an organophilic clay, a zeolite, a contaminant-absorbent, a contaminant-adsorbent, an ion-exchange material, a contaminant-reactant, a contaminant-neutralizing material, and mixtures thereof as separately applied or intermixed material, with or without contaminant-feeding microorganisms. The powdered or granular materials including filler materials, such as sand, rock and/or rip-rap may be applied as an admixture, or applied sequentially within the reactive geocomposite mat, and/or gabion cage contaminant structure. Preferably, the reactive geocomposite is filled with contaminant-reactive powdered or granular material in an amount of at least about 10 $lb/ft^3$ up to about 150 $lb/ft^3$, preferably about 30 $lb/ft^3$ to about 100 $lb/ft^3$, throughout the thickness, or throughout any upper central or lower portion of the thickness resulting in an article that has a water permeability of at least $1\times10^{-6}$ cm/sec, preferably in the range of $10^{-4}$ to $10^{2}$ cm/sec.

In terms of $ft^2$ of powdered or granular reactive material contained within the reactive geocomposite mat 11, based on surface area, some target loadings for various reactive materials (which can vary about 50% up or down) are as follows:

| | REACTANT LOADING |
|---|---|
| Organoclay | 0.82 $lb/ft^2$ |
| 100% Carbon | 0.53 $lb/ft^2$ |
| 100% Sand | 0.62 $lb/ft^2$ |
| 60% Carbon/40% Sand | 0.67 $lb/ft^2$ |
| 90% Carbon/10% Sand | 0.56 $lb/ft^2$ |

The above and other aspects and advantages of the contaminant-reactive gabion/geocomposite articles and their methods of manufacture will become apparent from the following detailed description of the preferred embodiments taken in conjunction with the drawings.

BRIEF DESCRIPTION OF THE DRAWINGS

Turning now to FIG. 1, there is shown a schematic diagram for a preferred embodiment of manufacturing the reactive gabion articles 10 described herein.

As shown in FIG. 1, the preferred reactive gabion/geocomposite article 10 comprises a reactive geocomposite mat 11 disposed below a gabion cage 13. The reactive geocomposite mat 11 includes, in one embodiment, woven or non-woven liquid-permeable outer geotextile sheet material layers 16 and 18 on both major exterior surfaces to confine a reactive material 17 therebetween. The powdered or granular reactive materials 17, such as a contaminant (organic) reactant absorbent or adsorbent are confined between cover sheets 16 and 18, or, in another embodiment, can be vibrated into a high loft geotextile, as described in this assignee's patent application Ser. No. 11/599,080 filed Nov. 14, 2006, hereby incorporated by reference. Optionally, a water-absorbent or water-swellable material, such as sodium bentonite clay and/or other sodium smectite clay, can be included (e.g., at seams) with the contaminant-reactant material(s) disposed between cover sheets 16 and 18 or held within a high loft geotextile, so long as the geocomposite mat 11 is water-permeable. Any of these features can be used alone or together with any of the other features, shown in FIGS. 1 through 4, to provide very unique reactive gabion/geocomposite articles 10 having any number of different properties and the capability of containing the spread of contaminants.

As shown in FIGS. 1, 2A, 2B and 3, there are illustrated methods and apparatus, including a number of optional features each of which can be used alone or in combination with any of the other features, for manufacturing a product having single or plurality of different granular or powdered materials, including contaminant-reactant materials, and having a gabion cage structure 13 above or surrounding a reactive geocomposite mat 11 to provide various characteristics or properties to the finished gabion/geocomposite article 10, as will be described in more detail hereinafter.

Figure 1:
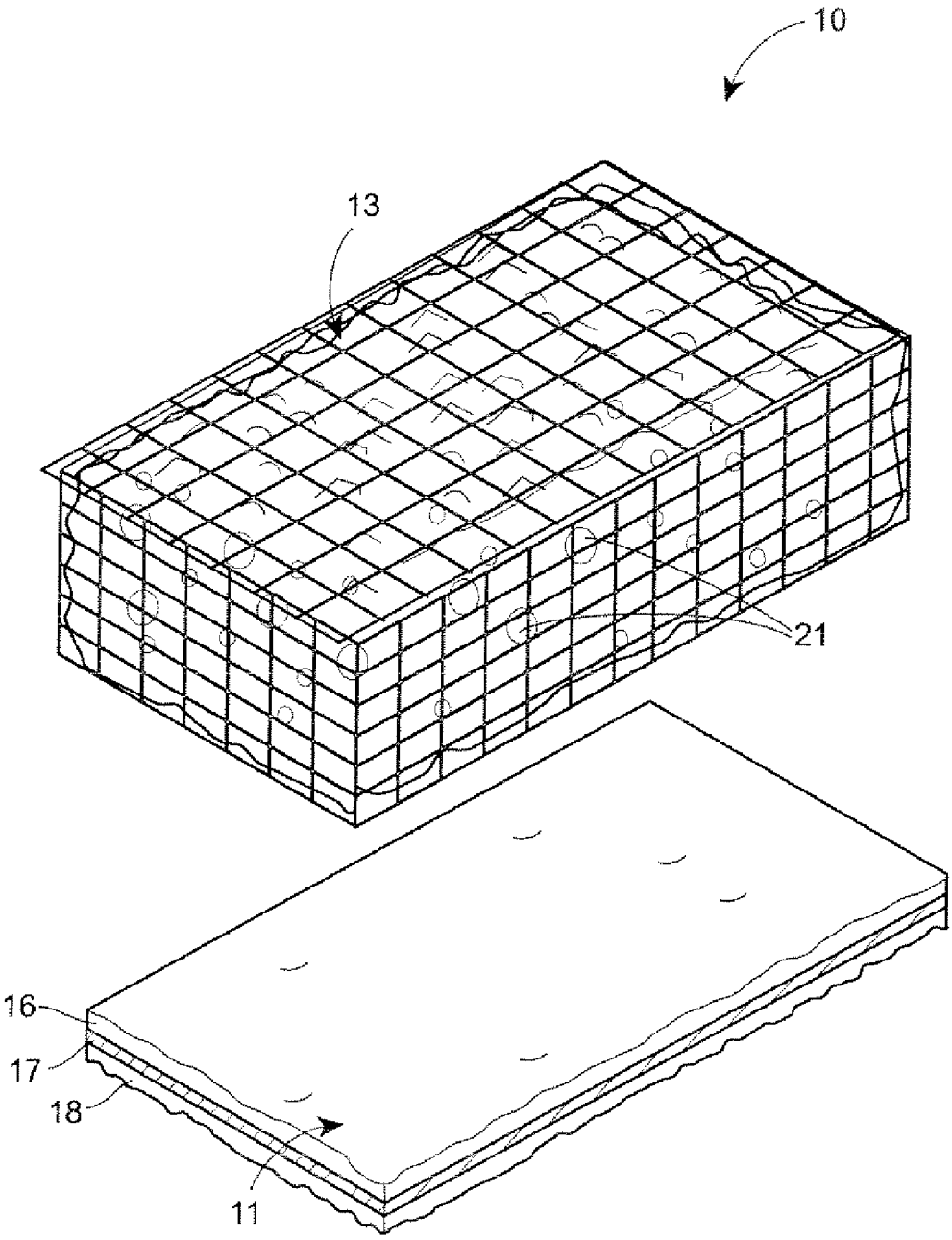
FIG. 1 is a perspective view of a gabion cage prior to connecting a reactive geocomposite mat to the gabion cage undersurface.

In accordance with the embodiment shown in FIG. 1, a reactive material-containing geocomposite mat 11 is joined to a gabion cage 13 to form a reactive gabion/geocomposite article 10, in a manner such that the gabion cage 13 is deployed above the reactive geocomposite mat 11. The gabion cage 13 can be weighted with rock 19, rip-rap, or the like, within or above the gabion cage 13, to hold the reactive geocomposite article 10 in position if, for example, the cage 13 is made from a polymeric material. Alternatively, if the cage 13 is metal, it may be heavy enough to maintain its deployed position without a weighting material therein or thereon.

Figure 2A:
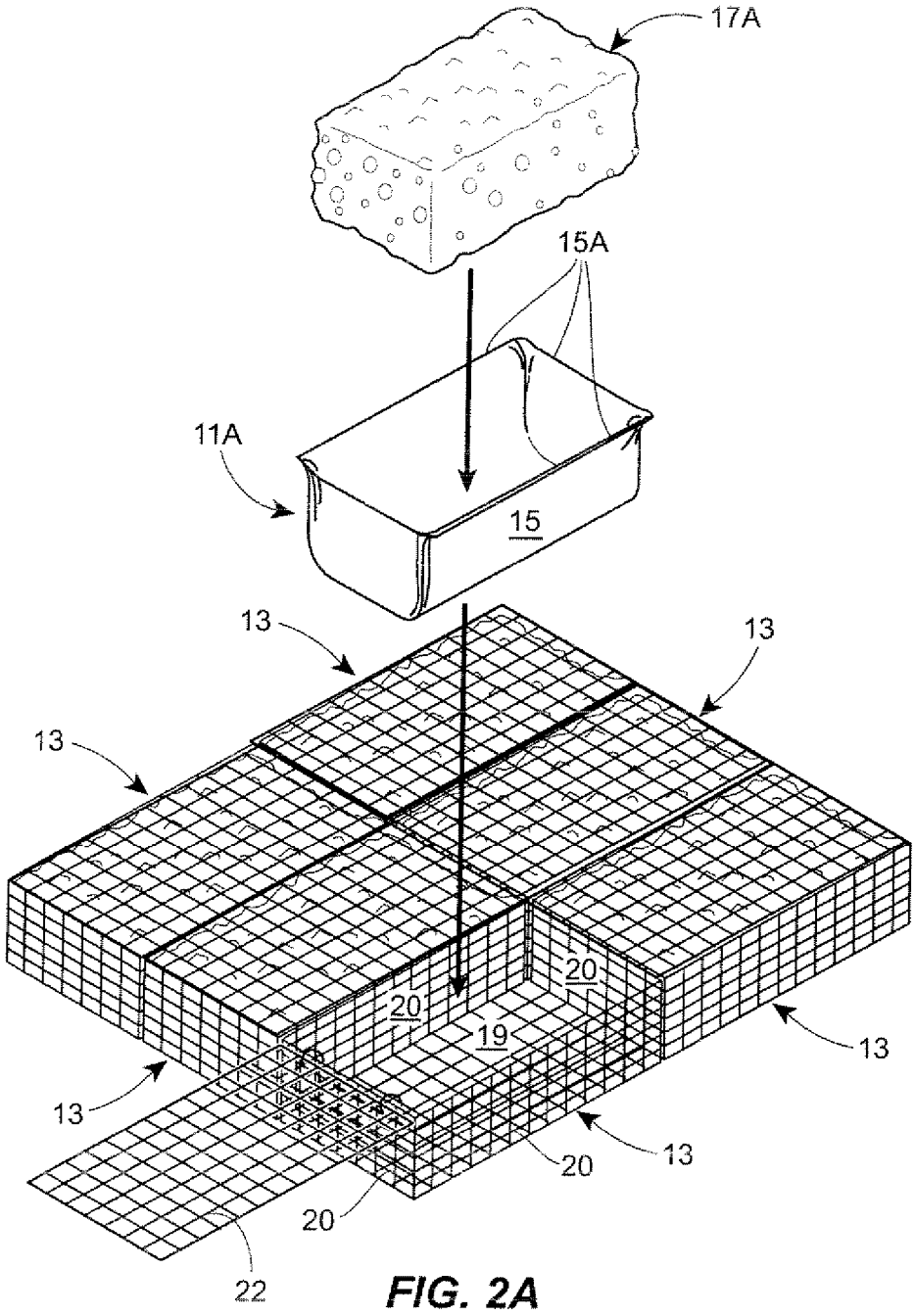
FIG. 2A is a perspective view of one embodiment of placing a reactive material in a geotextile that lines an inner surface of the gabion cage.
Figure 2B:
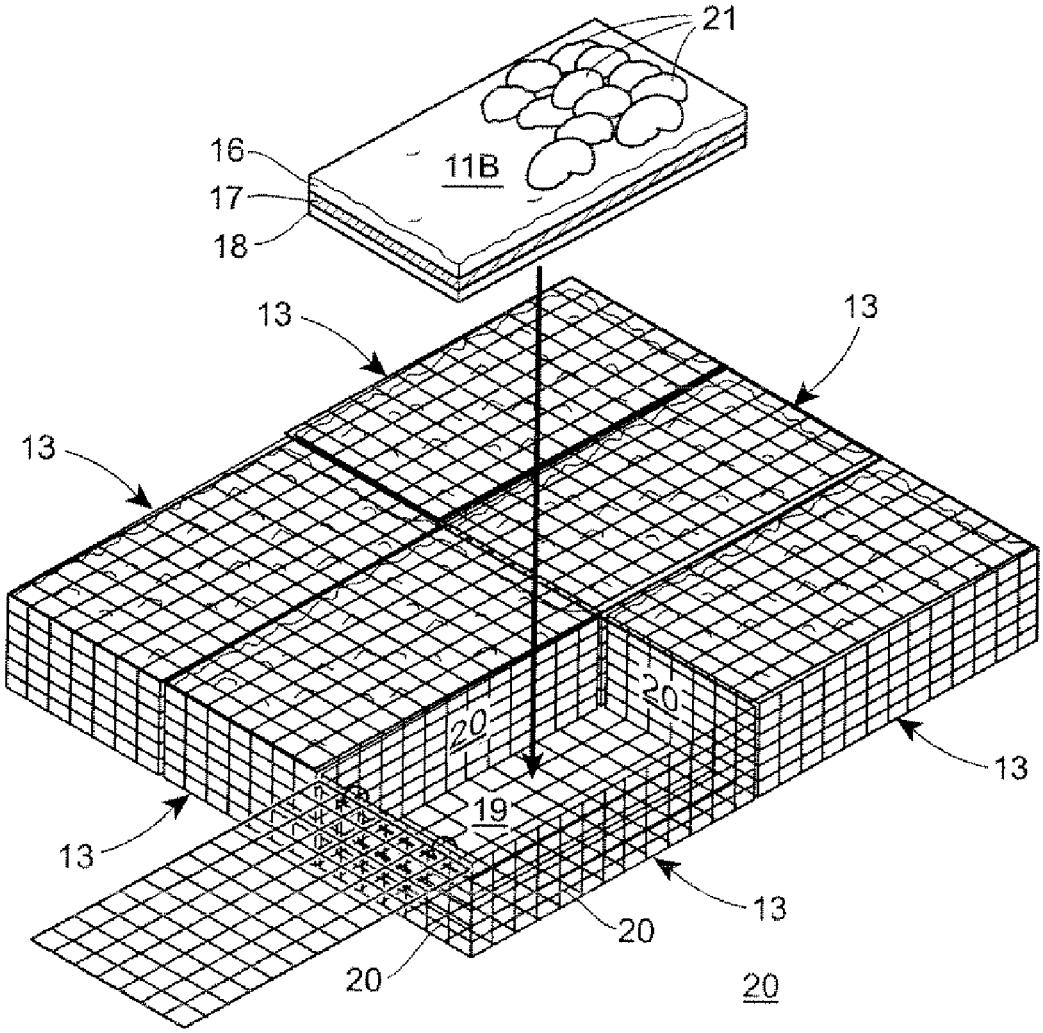
FIG. 2B is another embodiment of lining an inner bottom surface of a gabion cage with the reactive geocomposite article shown in FIG. 1, cut to the size of the gabion cage bottom wall.
Figure 4:
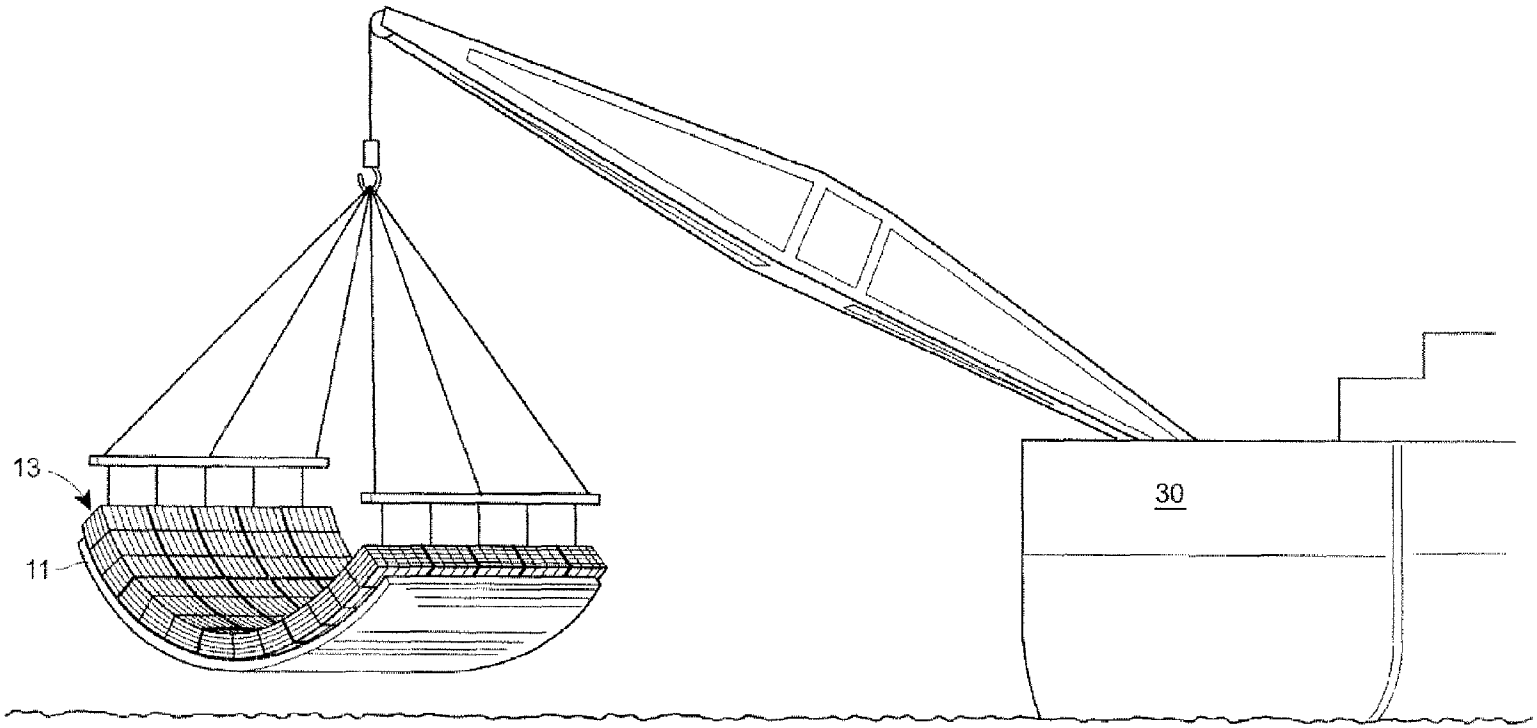
FIG. 4 is a perspective view, showing a gang of gabion cages, having a reactive geocomposite article secured thereunder, being dropped in place over waterway contaminants.

Generally, in all embodiments described herein, multiple gabion cages 13 are connected together, (called a gang of cages) as shown in FIGS. 2A, 2B, and 4. When reactive geocomposite mats 11 are connected to a bottom of the gang of gabion cages, the reactive geocomposite mat 11 may be individually connected to each cage 13, as shown in FIG. 1, or a larger reactive geocomposite mat 11 may be of sufficient size to cover an undersurface of the gang of gabion cages 13, as shown in FIG. 4, thereby covering the undersurface of all connected gabion cages with a single reactive geocomposite mat 11.

Figure 3:
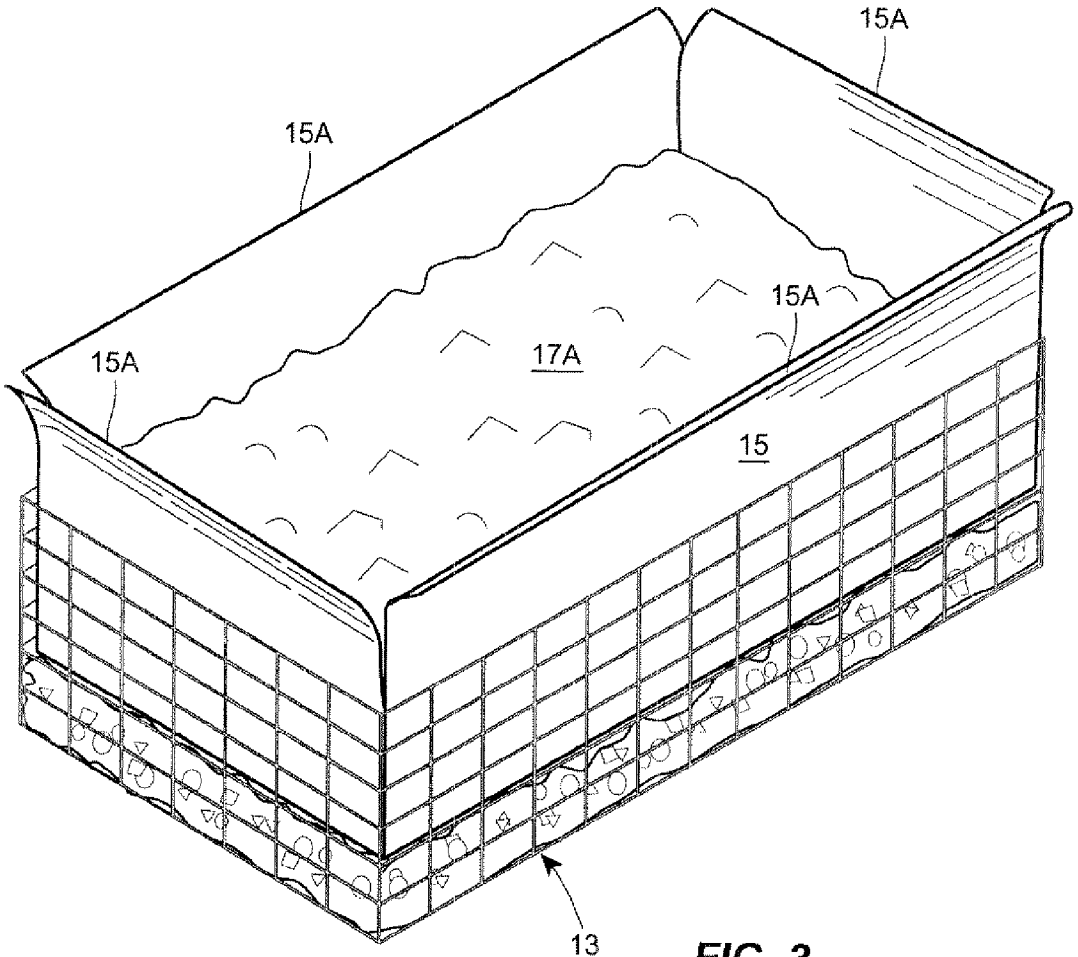
FIG. 3 is a perspective view, during manufacture, of one embodiment of the manufacturing method FIG. 2A, whereby excess geotextile is folded and connected over the reactive material to confine the reactive material within the gabion cage during deployment.

In accordance with additional important embodiments of the gabion/geocomposite articles and deployment methods described herein, as shown in FIGS. 2A, 2B and 3, the reactive geocomposite is disposed inside the gabion cages 13, each cage having an optional cover grid 22. In one method of disposing a reactive geocomposite article inside a gabion cage, as shown in FIG. 2A, a reactive geocomposite, hereinafter designated by reference numeral 11A, is formed in place within each gabion cage 13. As shown in FIG. 2A, a geotextile 15 is disposed inside a gabion basket 13 to line an upper surface of a bottom wall 19 of the gabion basket 13, as well as the side walls 20, forming an empty geotextile sack within each gabion cage 13. At least one reactive material 17A then is dropped into the geotextile sack, optionally together with additional layers of other reactive materials (or admixtures of reactive materials) and optionally admixed with, or provided as a separate layer, of weighting materials, such as sand, rock 19, rip-rap, or the like.

In accordance with a preferred method of maintaining the reactive material 17A within the geotextile sack, as shown in FIG. 3, the sack is not completely filled so that a top edge 15A of the geotextile material can be folded over an upper surface of the reactive material 17A (and over other optional materials added to the sack). The top edge 15A of the geotextile material 15 then is secured over the reactive material-containing sack, forming a sack cover, such as by using fasteners, e.g., staples, or wire or plastic clips, or by heat or ultrasonically welding the top edge 15A of the formed cover of the geotextile sack, over the material(s) added to the geotextile sack to prevent the reactive material(s) from being forced out of the gabion 13 by aquafers or water currents.

In accordance with another important embodiment of the gabion/geocomposite articles and deployment methods described herein, as shown in FIG. 2B, each gabion cage 13 is lined on an upper surface of the bottom wall 16 of the cage 13 with a layer of the reactive geocomposite mat 11B. In a preferred embodiment, each reactive geocomposite article liner 11B is cut to the dimensions of the upper surface of the bottom wall 19 of the gabion cages 13. A gang of gabion baskets 13, each lined on an inside of its bottom wall 19, therefore, will be capable of treating contaminated water over the full bottom dimension of the gang of cages 13, since reactive material 17 from adjacent gabion cage mats 11B will spill over the side wall (e.g., 20 in FIG. 2B) for treatment of any contaminated water attempting to move vertically upward around the wall 20, without traversing one of the reactive geocomposite mats 11B. The reactive geocomposite may be covered by a layer of rock, rip rap or the like 21.

FIG. 4 shows ship 30 deployment of a connected gang of weighted gabion cages 13 secured together, and having a single reactive geocomposite mat 11 secured to an undersurface of the entire gang of gabion cages.

What is claimed:

1. A reactive gabion cage structure for treating contaminants in soil, sediment or water comprising a water-pervious, reactive geotextile sack that covers an upper surface of a bottom wail and four side walls of the gabion, said sack containing a powdered or granular reactive material disposed within the sack in the gabion cage structure;

a gabion cage structure disposed to hold the reactive material within the geotextile sack in position within the gabion cage structure, said gabion cage structure having an integral or added weighting material to hold the reactive geotextile sack in place within the gabion cage structure and on a contaminated underwater sediment or above-water soil location.

2. The reactive gabion cage structure of claim 1, wherein the powdered or granular material is selected from group consisting of activated carbon, coke breeze, zero-valent iron, magnetite, apatite, organophilic clay, zeolite, polymeric ion exchange resins, polymeric adsorbing resins, microorganisms, and mixtures thereof.

3. The reactive gabion cage structure of claim 1, wherein the water-pervious reactive geotextile sack contains multiple reactive materials.

4. The reactive gabion cage structure of claim 1, wherein the reactive material has a particle size such that at least 90% of the particles have a size in the range of about 6 mesh to about 325 mesh.

5. The reactive gabion cage structure of claim 1, wherein the gabion/geocomposite article has 30 lb/ft3 to 100 lb/ft3 of powdered or granular reactive material contained within the reactive geocomposite sack.

6. A method of manufacturing a reactive gabion cage structure capable of sorbing, reacting with, or neutralizing a liquid-contained contaminant comprising:

providing a water-permeable geotextile sheet or fabric and positioning the geotextile sheet or fabric into a gabion cage structure, such that the geotextile sheet or fabric covers a bottom and four inside side walls of the gabion cage structure;

adding a contaminant-reactive material layer within the geocomposite sheet or fabric;

folding the geotextile sheet or fabric over the contaminant-reactive material layer such that the geotextile sheet or fabric completely covers an upper surface of the contaminant reactive material layer;

securing the geotextile sheet together over the upper surface of the contaminant-reactive material to confine the contaminant-reactive material within the gabion grid structure.

7. The method of claim 6, further including fastening the geocomposite sheet or fabric together at its upper edge, to confine the contaminant reactive material within the geocomposite sheet or fabric.

8. The method of claim 6, further comprising folding upper edges of the geocomposite sheet or fabric over an upper surface of the contaminant reactive material layer and adhering the upper folded geocomposite sheet or fabric edges together.

* * * * *